US005655557A

United States Patent [19]

Martin

[11] Patent Number: 5,655,557

[45] Date of Patent: Aug. 12, 1997

[54] UMBRELLA FRAME

[75] Inventor: Leo Martin, Coconut Grove, Fla.

[73] Assignee: Miami Metal Products, Inc.

[21] Appl. No.: 731,832

[22] Filed: Oct. 21, 1996

Related U.S. Application Data

[63] Continuation-in-part of Ser. No. 428,024, Apr. 25, 1995, abandoned.

[51] Int. Cl.[6] ..... A45B 3/00

[52] U.S. Cl. ..... 135/15.1; 135/29; 135/32

[58] Field of Search ..... 135/19, 19.5, 16, 135/15.1, 20.2, 28, 29, 31, 32

[56] References Cited

U.S. PATENT DOCUMENTS

| | | | |
|---|---|---|---|
| 448,203 | 3/1891 | Brice | 135/19 |
| 1,088,743 | 3/1914 | Swinland . | |
| 1,095,362 | 5/1914 | Swinland | 135/15.1 |
| 1,555,568 | 9/1925 | Gustafson | 135/29 X |
| 2,132,648 | 10/1938 | Rosenberg et al. | 135/29 |
| 2,762,383 | 9/1956 | Wittman | 135/28 |
| 2,796,073 | 6/1957 | Wittman | 135/28 |
| 5,085,239 | 2/1992 | Chin-Hung et al. | 135/28 X |
| 5,271,196 | 12/1993 | Fanti | 135/16 X |
| 5,273,062 | 12/1993 | Mozdzanowski | 135/16 |

*Primary Examiner*—Lanna Mai

[57] ABSTRACT

An umbrella frame comprises a plurality of main ribs attached to a slidable moving plate assembly by a plurality of support ribs. A plurality of stabilizing ribs are secured to the support ribs. The stabilizing ribs are further secured to a stationary plate assembly in a manner which permits the main ribs to open by gravity thus resulting in an umbrella frame whose relaxed state is open. An upper plate assembly is secured to the umbrella frame pole by an energy absorbing and dissipating means to stabilize the umbrella in windy conditions.

4 Claims, 3 Drawing Sheets

UMBRELLA FRAME

This is a continuation-in-part of application Ser. No. 08/428,024, filed Apr. 25, 1995, now abandoned.

FIELD OF THE INVENTION

The present invention relates to a standing umbrella frame. More specifically, the present umbrella frame is one that, in its relaxed state, is in the open position and stabilizes in windy conditions.

BACKGROUND OF THE INVENTION

Standing umbrellas are well known for providing shade from the sun as well as protection from other inclement weather. Standing umbrellas are typically set into a base to keep them upright. Another method for providing the upright stature of the standing umbrella is to place it within the center of a table, such as a patio table, while still placing the umbrella's pole within a base for stabilization.

For either method of retaining the standing umbrella upright, the umbrella may be opened for use to shield the weather elements and may be closed when not in use. Umbrellas generally in the relaxed state are in the closed position. In order to open the umbrella, a number of devices have been conceived such as crank or pulley systems. Some of these methods, and others, are described in the following U.S. patents:

SMALL, U.S. Pat. No. 3,410,285

BECHER, U.S. Pat. No. 4,011,881

BECHER, U.S. Pat. No. 4,424,824

DALO ET AL., U.S. Pat. No. 4,637,415

YUNG, U.S. Pat. No. 4,685,482

HAINES, U.S. Pat. No. 4,813,442

While these devices apparently achieve their intended purpose, they are difficult and cumbersome to open especially when surrounded by a table. Furthermore, these devices do not provide an energy absorbing and dissipating means designed to stabilize the umbrella in windy conditions.

SUMMARY OF THE INVENTION

The present invention comprises an umbrella frame that is opened in its relaxed state. The frame comprises a plurality of main ribs attached to a slidable moving plate assembly by a plurality of support ribs. A plurality of stabilizing ribs are secured to the support ribs. The stabilizing ribs are further secured to a stationary plate assembly in a manner which permits the main ribs to open by gravity thus resulting in an umbrella frame whose relaxed state is open. An upper plate assembly is secured to the umbrella frame pole by an energy absorbing and dissipating means to stabilize the umbrella in windy conditions.

Thus, it is an object of the present invention to provide an umbrella frame having its relaxed state in the open position.

It is another object of the present invention to provide an umbrella frame capable of absorbing and dissipating different levels of wind speed and velocity.

Further objects of the present invention will be readily apparent in the drawings, specification, and claims as set forth below.

BRIEF DESCRIPTION OF THE DRAWINGS

The features embodying the present invention are illustrated in the accompanying drawings, forming a part of this application, in which.

DETAILED DESCRIPTION OF A PREFERRED EMBODIMENT

Figures 1, 2, 3:
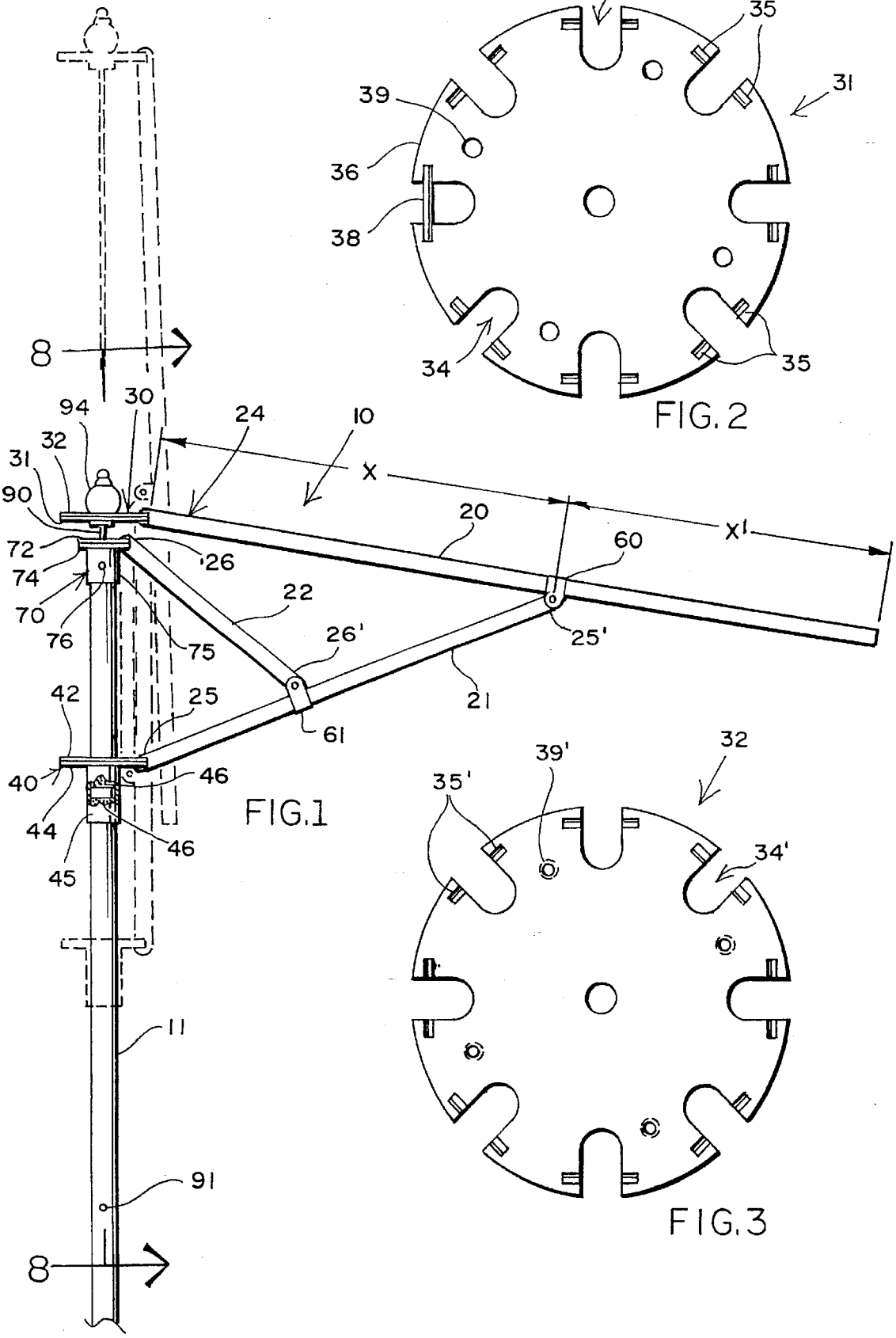
FIG. 1 is a vertical standing partial view of the present invention with ribs extended; and phantom lines showing the ribs drawn closed.
FIG. 2 is a top plan view of the bottom section of the upper plate assembly of the present invention.
FIG. 3 is a bottom plan view of the top section of the upper plate assembly of the present invention.

A detailed description of a preferred embodiment of the present invention may be seen in FIG. 1. In FIG. 1, umbrella frame 10 is shown. The frame 10 is comprised of a pole 11 attached to a base (not shown) and a plurality of ribs and plate assemblies as further described.

The extensions of frame 10 comprise a plurality of main ribs 20, support ribs 21 and stabilizing ribs 22. The number of ribs may depend upon the overall length of the umbrella frame 10. However, as disclosed, the frame 10 has eight (8) main ribs 20, eight (8) support ribs 21 and four (4) stabilizing ribs 22. Further as disclosed herein, the approximate length of main rib 20 is forty seven inches; of support rib is twenty seven inches; and of stabilizing rib is fourteen inches. The shape of each rib is generally elliptical, though shape is not a determining factor as rib shapes matable with the plate assemblies' cutouts may be by design choice.

Main rib 20 has a proximal end 24 which is connected to an upper plate assembly 30. Upper plate assembly 30 is generally comprised of bottom section 31 as seen in FIG. 2 and top section 32 as seen in FIG. 3.

Bottom section 31 is disk shaped and has a plurality of cutouts 34 on its periphery to accommodate the shape and number of main ribs 20. In the preferred embodiment, these cutouts 34 have a "U" shape with the opening away from the center of the section 31. Further, each cutout 34 has a bilateral channel 35 transversely across each "U" shape along the edge 36 of bottom section 31. The channel 35 houses a pin 38 that is first inserted through a hole (not shown) of the proximal end 24 of main rib 20.

Top section 32 of upper plate assembly 30 has corresponding cutouts 34' and channels 35' to overlay the bottom section 31. Pins 38 are inserted through the proximal ends 24 of each main rib 20 (hole)⁻ and then each pin 38 is placed in a channel 35. Bottom section 31 has threaded holes 39 which are alignable with clearance holes 39' on top 32. The bottom section 31 and top section 32 are then placed together and secured into place through the respective threaded holes 39 and clearance holes 39' by screws (not shown) resulting in an integral unit, the upper plate assembly 30.

Figure 4:
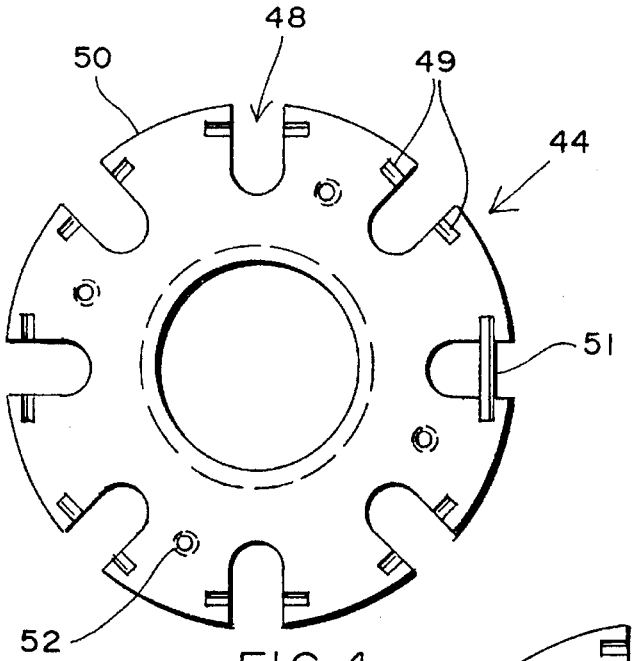
FIG. 4 is a top plan view of the bottom section of the moving plate assembly of the present invention.
Figure 5:
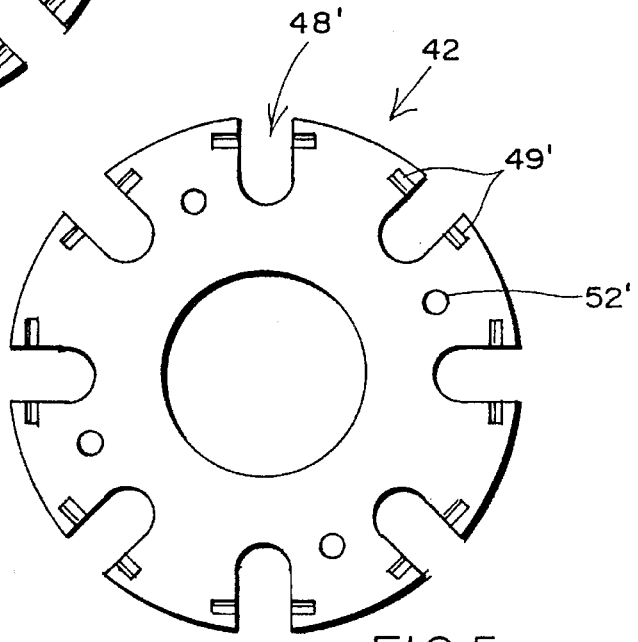
FIG. 5 is a bottom plan view of the top section of the moving plate assembly of the present invention.

Support rib 21 is connected at its proximal end 25 to a moving plate assembly 40. Moving plate assembly 40 is generally comprised of bottom section 41 as seen in FIG. 4 and top section 42 as seen in FIG. 5.

Bottom section 41 is comprised of a disk shape 44 with an integral cylinder 45 securely and concentrically affixed thereunder. The diameter of cylinder 45 is larger than that of pole 11 about which bottom section is fitted. Furthermore, a pair of bushings 46, preferably made of a synthetic plastic material, for example, DELRIN, is capped within each end of cylinder 45. The inside diameter of bushings 46 should be slightly larger that the outside diameter of pole 11 so that the moving plate assembly 40 can slide with relative ease up and down the pole 11.

The disk shape 44 portion of bottom section 41 of moving plate assembly 40 has a plurality of cutouts 48 on its periphery to accommodate the shape and number of support ribs 21. In the preferred embodiment, these cutouts 48 have a "U" shape with the opening away from the center of the section 41. Further, each cutout 48 has a bilateral channel 39 transversely across each "U" shape along the edge 50 of disk 44 of bottom section 41. The channel 39 houses a pin 51 that is first inserted through a hole (not shown) of the proximal end 25 of support rib 21.

Top section 42 of moving plate assembly 40 has corresponding cutouts 48' and channels 49' to overlay the disk 44 of bottom section 41. Pins 51 are inserted through the proximal ends 25 of each support rib 21 (hole) and then each pin 51 is placed in a channel 49. Bottom section 41 has threaded holes 52 which are alignable with clearance holes 52' on top 42. The bottom section 41 and top section 42 are then placed together and secured into place through the respective threaded holes 52 and clearance holes 52' by screws (not shown) resulting in an integral unit, the moving plate assembly 40.

Support rib 21 has a distal end 25' which is attached to main rib 20 by a first rib bracket 60 by means of a rivet through said first rib bracket 60 and hole through the distal end 25' of support rib 21. The opposite end of first rib bracket 60 is secured to the main rib 20 by conventional means such as screws (not shown).

The location of first rib bracket 60 along the length of main rib 20 is critical to allow gravity to force the umbrella frame 10 in an opened position in the relaxed state. The "relaxed state" of umbrella frame 10 is when the main ribs 20 are substantially fully extended. No catch is required on the pole 11 to maintain the main ribs 20 in their fully extended condition. The "relaxed state" of frame 10 is defined by the location of first rib bracket 60 with respect to main rib 20. Where main rib 20 is divided into length X and X', the center point of first rib bracket 60 needs to be positioned along main rib 20 such that X is greater than or equal to X'. When first rib bracket 60 is positioned along main rib 20, which is rigid and planar, such that X is greater than or equal to X', gravity urges the weight of the umbrella frame 10 downwardly at the central pinnacle point of the upper plate assembly 30 location. This resultant downward movement is caused by an insufficient upward counter force of support ribs 21 due to the positioning of rib bracket 60 along main ribs 20. In other words, when X equals X', the main ribs 20 are at equilibrium. However, due to the additional weight of the tarp 95 (not shown) on the X area of the frame 10, coupled with the weight of the upper plate assembly 30, the main ribs 20 are gravitationally urged to their relaxed state which, again, is substantially fully extended. The greater the ratio of X to X', the faster the main ribs 20 achieve their substantially fully extended position.

Figure 6:
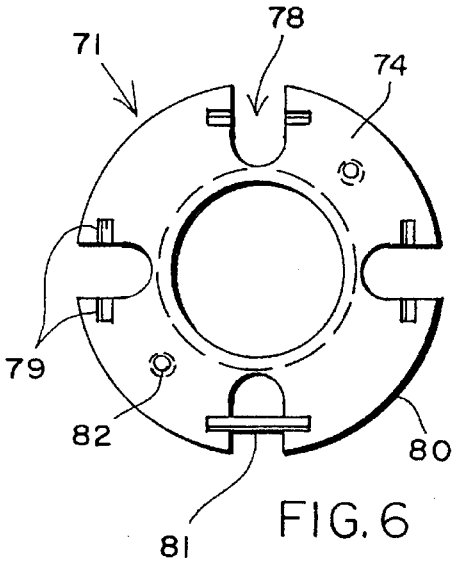
FIG. 6 is a top plan view of the bottom section of the stationary plate assembly of the present invention.
Figure 7:
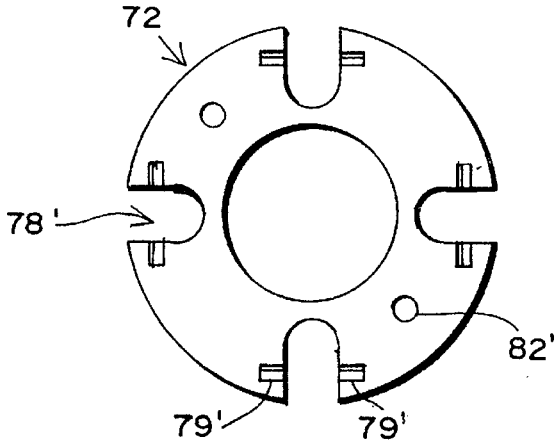
FIG. 7 is a bottom plan view of the top section of the stationary plate assembly of the present invention.

Stabilizing rib 22 is connected at its proximal end 26 to a stationary plate assembly 70. Stationary plate assembly 70 is generally comprised of bottom section 71 as seen in FIG. 6 and top section 72 as seen in FIG. 7.

Bottom section 71 is further comprised of a disk shape 74 with an integral cylinder 75 securely and concentrically affixed thereunder. The diameter of cylinder 75 is larger than that of pole 11 about which the bottom is fitted. A set screw 76 on fits through a corresponding hole on cylinder 75 to secure it onto pole 11. When the set screw 76 is released and main ribs 20 drawn closed, the entire structure is capable of sliding down pole 11 for packaging and shipping, or for storage.

The disk shape 74 portion of bottom section 71 has a plurality of cutouts 78 on its periphery to accommodate the shape and number of stabilizing ribs 22. In the preferred disclosure, these cutouts 78 have a "U" shape with the opening away from the center of the section 71. Further, each cutout 78 has a bi-lateral channel 79 transversely across each "U" shape along the edge 80 of disk 74 of bottom section 41. The channel 79 houses a pin 81 that is first inserted through a hole (not shown) of the proximal end 26 of stabilizing rib 22.

Top section 72 of stationary plate assembly 70 has corresponding cutouts 78' and channels 79' to overlay the disk 74 of bottom section 71. Pins 81 are inserted through the proximal ends 26 of each stabilizing rib 22 and then each pin 81 is placed in a channel 79. Bottom section 71 has threaded holes 82 which are alignable with clearance holes 82' by a screw (not shown) resulting in an integral unit, the stationary plate assembly 70.

Stabilizing rib 22 has a distal end 26' which is attached to support rib 21 by a second rib bracket 61 by means of a rivet through said second rib bracket 61 and hole through the distal end 26' of stabilizing rib 22. The opposite end of second rib bracket 61 is secured to the support rib 21 by conventional means such as screws (not shown).

Figure 8:
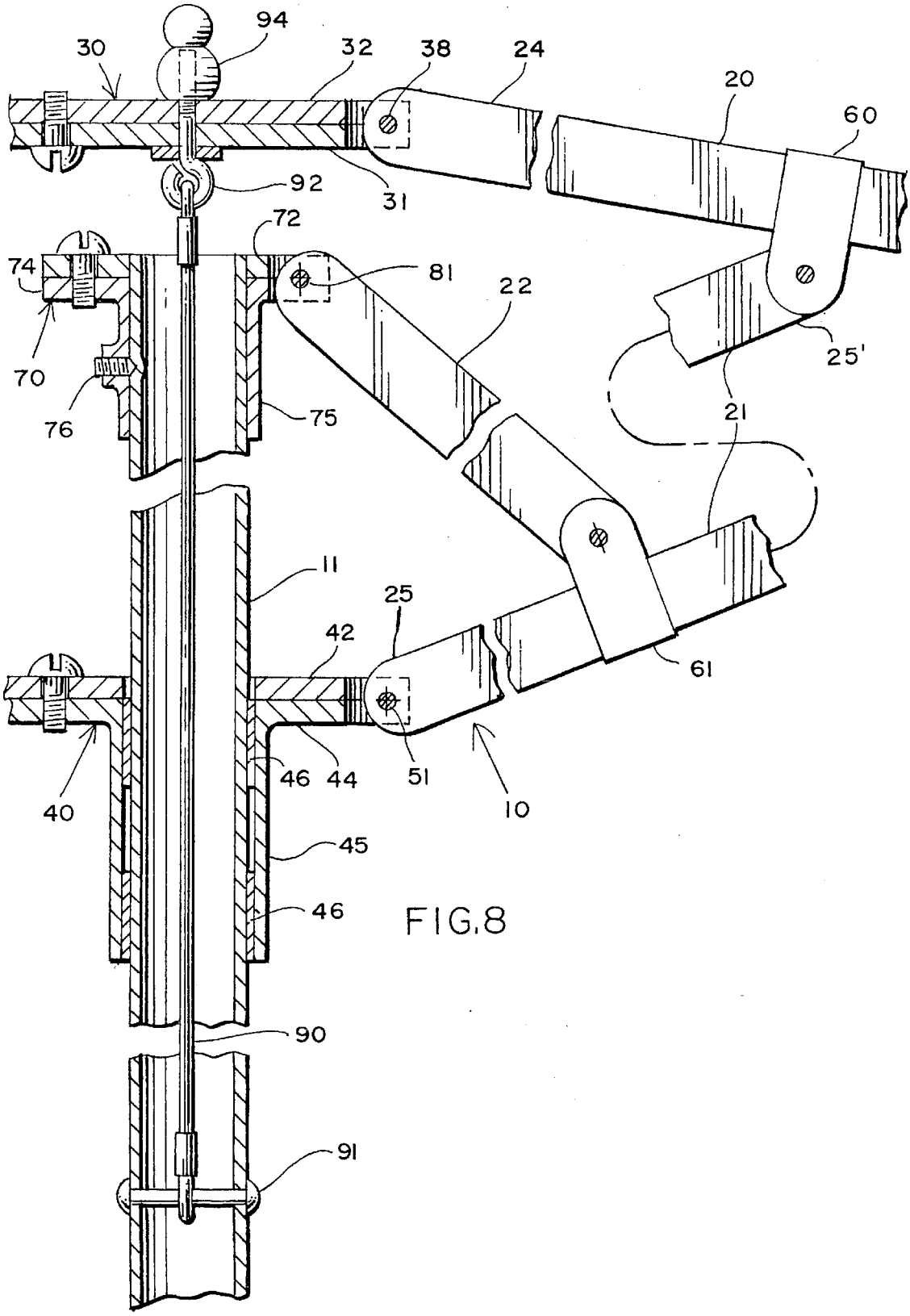
FIG. 8 is a cross section view taken along line 8—8 of FIG. 1 with a tarp shown in broken lines.

In FIG. 8, means for energy absorption and dissipation connects pole 11 with upper plate assembly. In the preferred embodiment, an elastic cord 90, generally referred to as a BUNGEE cord, is secured to pole 11 at lower anchor 91, through stationary plate assembly 70, and to upper anchor 92. Upper anchor 92 is secured into upper plate assembly 30. A finial 94 may be attached to the top of upper plate assembly 30 to give the frame 10 a finished look. While the energy absorbing and dissipating means preferred is an elastic cord 90, and such means, for example, a spring or pneumatic or hydraulic cylinder, may be employed.

This energy absorbing and dissipating means has been found to enhance the stability of the frame 11. When wind gusts upwardly into the underside of tarp 95 of the umbrella frame 10, the cord 90 is stretched upwardly which causes the main ribs 20 to begin to draw into a closing, or downward, position. When the main ribs 20 draw in this direction, less volume results within the underside of the tarp 95 thus stabilizing the frame 10.

To close the frame 10, the substantially fully extended main ribs 20 are drawn downwardly in close proximity, or adjacent, to pole 11. A tie-down 96 (not shown) on tarp 95 is pulled around the tarp 95 and secured.

It is intended that the description of the preferred embodiments of this invention is illustrative only. Other embodiments of the invention that are within the scope and concept of this invention are herein included within this application.

What is claimed is:

1. A standable umbrella frame comprising, in combination;

a pole having a bottom base and an upper end;

a stationary plate assembly releaseably securable to said upper end of said pole, a moving plate assembly which is slidably fitted around said pole, and an upper plate assembly having energy absorbing and dissipating means connecting said upper plate assembly to said pole;

a plurality of main ribs each having a proximal end and a distal end with means attaching said proximal end to said upper plate assembly, a plurality of support ribs each having a proximal end and a distal end with means attaching said proximal end of said support ribs to said moving plate assembly and first bracket means securing said distal end of said support rib to said main rib, and a plurality of stabilizing ribs each having a proximal end and a distal end with means attaching said proximal end of said stabilizing ribs to said stationary plate assembly and second bracket means securing said distal end of said stabilizing rib to said support rib, wherein said first bracket means dissects said main rib into a first main rib section adjacent to said proximal end of said main rib and a second main rib section such that said first main rib section has a length which is at least equal to the length of said second main rib section to urge gravitationally said slidable moving plate assembly toward the upper end of said pole to a stationary position having no catch means on said pole and upon which to support said moving plate such that said main ribs substantially fully extend outwardly and thus openly from said pole and maintain said outward and open extension.

2. The umbrella frame as set forth in claim 1, wherein said energy absorbing and dissipating means comprises an elastic cord.

3. The umbrella frame as set forth in claim 2, wherein pole has a lower anchor and said cord is attached to said upper plate assembly and to said lower anchor.

4. The umbrella frame as set forth in claim 1, further comprising set screw means to releaseably secure said stationary plate assembly to said pole.

* * * * *